US006905364B2

(12) United States Patent
Swantner et al.

(10) Patent No.: US 6,905,364 B2
(45) Date of Patent: Jun. 14, 2005

(54) HIGH FREQUENCY RIGHT ANGLE CONNECTOR

(75) Inventors: Michael J. Swantner, Warren, PA (US); Shane Brown, York, PA (US); John Sherry, Warren, PA (US)

(73) Assignee: Osram Sylvania, Inc., Danvers, MA (US)

( * ) Notice: Subject to any disclaimer, the term of this patent is extended or adjusted under 35 U.S.C. 154(b) by 0 days.

(21) Appl. No.: 10/737,303

(22) Filed: Dec. 16, 2003

(65) Prior Publication Data

US 2005/0059275 A1 Mar. 17, 2005

Related U.S. Application Data

(60) Provisional application No. 60/503,619, filed on Sep. 17, 2003.

(51) Int. Cl.[7] ..... H01R 13/60; H01R 13/66

(52) U.S. Cl. ..... 439/541.5

(58) Field of Search ..... 439/541.5, 55, 439/79, 540.1; 361/399

(56) References Cited

U.S. PATENT DOCUMENTS 4,493,525 A * 1/1985 Hall et al. ..... 439/610
4,818,239 A * 4/1989 Erk ..... 439/55
4,861,271 A * 8/1989 Bogar et al. ..... 439/63
6,179,652 B1 * 1/2001 Tung et al. ..... 439/541.5
6,234,834 B1 * 5/2001 Tsai et al. ..... 439/541.5
6,500,026 B2 * 12/2002 Yamaguchi ..... 439/577
6,666,716 B2 * 12/2003 Chien-Chung ..... 439/541.5
6,676,443 B1 * 1/2004 Wang ..... 439/541.5

* cited by examiner

*Primary Examiner*—Chandrika Prasad
(74) *Attorney, Agent, or Firm*—William H. McNeil

(57) ABSTRACT

A high frequency, right angle socket (10) comprising a body (12) including a longitudinal bore (14) extending completely through the body (12) and a transverse bore (16) intersecting the longitudinal bore (14). The bores (14) and (16) are seem most clearly in FIG. 5. A first dielectric (18) is formed to frictionally engage the longitudinal bore (14). The dielectric (18) has a proximal end (26) and a distal end (22) and includes a longitudinal electric contact-receiving chamber (24). A right angle electrical contact (26) has a longitudinal portion (28) and a transverse portion (30). The longitudinal portion (28) includes a first contact retainer (32). The transverse portion (30) includes a contact retainer (33). The longitudinal portion (28) is fitted into the longitudinal electrical contact-receiving chamber (24) of the first dielectric (18) with the contact retainer (32) on the longitudinal portion (28) engaging the interior wall of the longitudinal contact-receiving chamber (24). A second dielectric (34) is formed to frictionally engage the transverse bore (16) and includes a transverse electrical contact-receiving (36). The transverse portion (30) of the right angle electrical contact (26) is fitted into the transverse electrical contact-receiving chamber (36) with the contact retainer (33) on the transverse portion (30) engaging the interior wall of the transverse electrical contact-receiving chamber (36). A cap (38) closes one end of the longitudinal bore (14).

8 Claims, 5 Drawing Sheets

HIGH FREQUENCY RIGHT ANGLE CONNECTOR

CROSS-REFERENCE TO RELATED APPLICATIONS

This application claims priority from Provisional Patent Application No. 60/503,619, filed Sep. 17, 2003.

TECHNICAL FIELD

This invention relates to electrical connectors and more particularly to high frequency right angle connectors.

BACKGROUND ART

High frequency right angle connectors C, shown in FIGS. 1 and 2, are known and a previous type was composed of a die cast body 100, three Teflon® screw machine dielectrics, 102, 104 and 106, a contact 108 and a die cast cap 110. The contact 108 was press-fitted into one of the dielectrics 102 to form a sub-assembly, which was then inserted into the die cast body 100. A second dielectric 104 was then placed over the corner of the contact 108. The third dielectric 106 was then placed over the short end of the contact 108 and pressed into an opening in the die cast body 100. The die cast cap 110 was then seated into the body 100 to complete the assembly.

This structure does not provide adequate shielding because of the gap 120 that exists at the bend of the contact 108. The gap extends completely around the bend. Also, the short dielectric 106 has no stop feature to prevent it from being pushed too fair into the die cast body. Therefore, the true position of the contact 108 was determined by the fit of the pin into the dielectric and the associated tolerances of each component. These conditions proved unacceptable for the use of the connector.

DISCLOSURE OF INVENTION

It is, therefore, an object of the invention to obviate the disadvantages of the prior art.

It is another object of the invention to enhance high frequency right angle connectors.

It is another object of the invention to reduce the number of parts necessary for the connector.

These objects are accomplished, in one aspect of the invention, by the provision of a high frequency, right angle socket comprising a body including a longitudinal bore extending completely through the body and a transverse bore intersecting the longitudinal bore. A first dielectric is formed to frictionally engage the longitudinal bore, the dielectric having a proximal end and a distal end and including a longitudinal electric contact-receiving chamber. A right angle electrical contact has a longitudinal portion and a transverse portion, the longitudinal portion including a first contact retainer. The transverse portion has a second contact retainer. The longitudinal portion is fitted into the longitudinal electrical contact-receiving chamber of the first dielectric with the contact retainer on the longitudinal portion engaging the interior wall of the longitudinal contact-receiving chamber. A second dielectric is formed to frictionally engage the transverse bore and includes a transverse electrical contact-receiving chamber. The transverse portion of the right angle electrical contact is fitted into the transverse electrical contact-receiving chamber with the contact retainer on the transverse portion engaging the interior wall of the transverse electrical receiving chamber. A cap closes one end of the longitudinal bore.

This construction provides fewer components and makes easier the correct positioning of the contact pin for both its mating end (the long portion) and the circuit board end (the short end). Shielding is effected by completely eliminating the gap around the bend of the contact pin. The cap is coined into place thus ensuring that it will remain in place during a soldering process.

BEST MODE FOR CARRYING OUT THE INVENTION

For a better understanding of the present invention, together with other and further objects, advantages and capabilities thereof, reference is made to the following disclosure and appended claims in conjunction with the above-described drawings.

Figure 1:
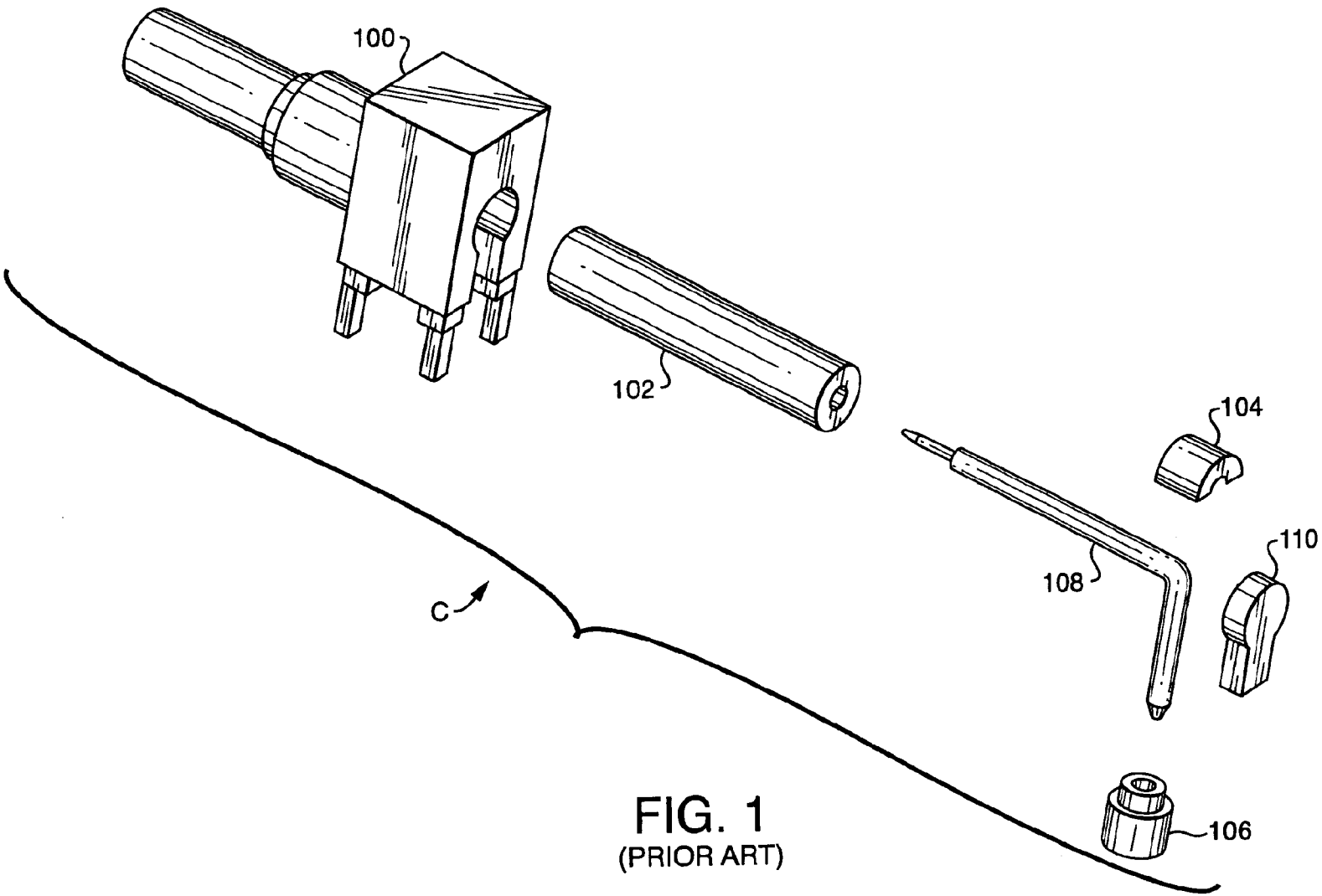
FIG. 1 (PRIOR ART)
FIG. 1 is an exploded perspective view of a prior art connector.
Figure 2:
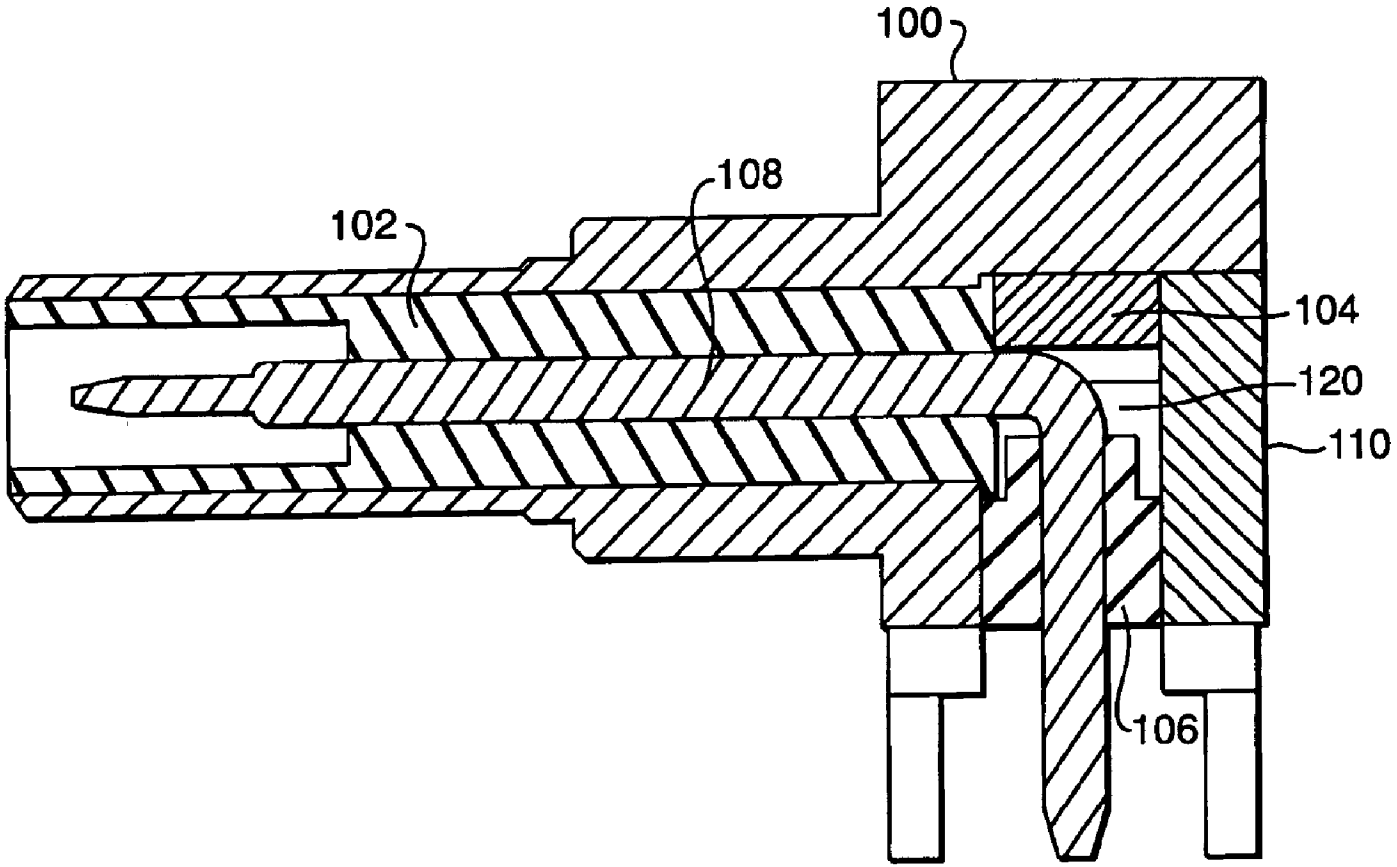
FIG. 2 (PRIOR ART)
FIG. 2 is a longitudinal sectional view of the connector of FIG. 1.
Figure 3:
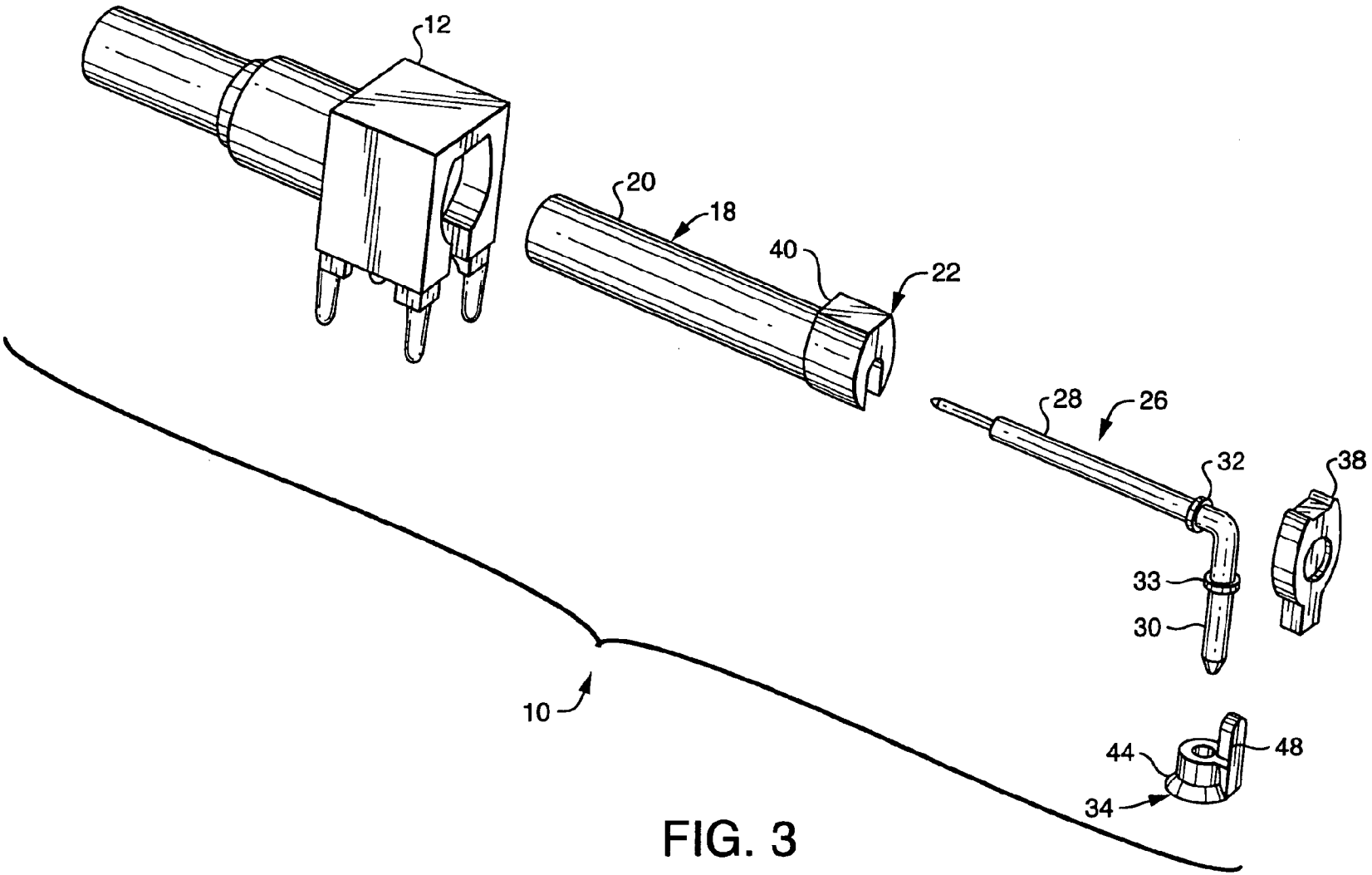
FIG. 3 is an exploded perspective view of an embodiment of the invention.
Figure 4:
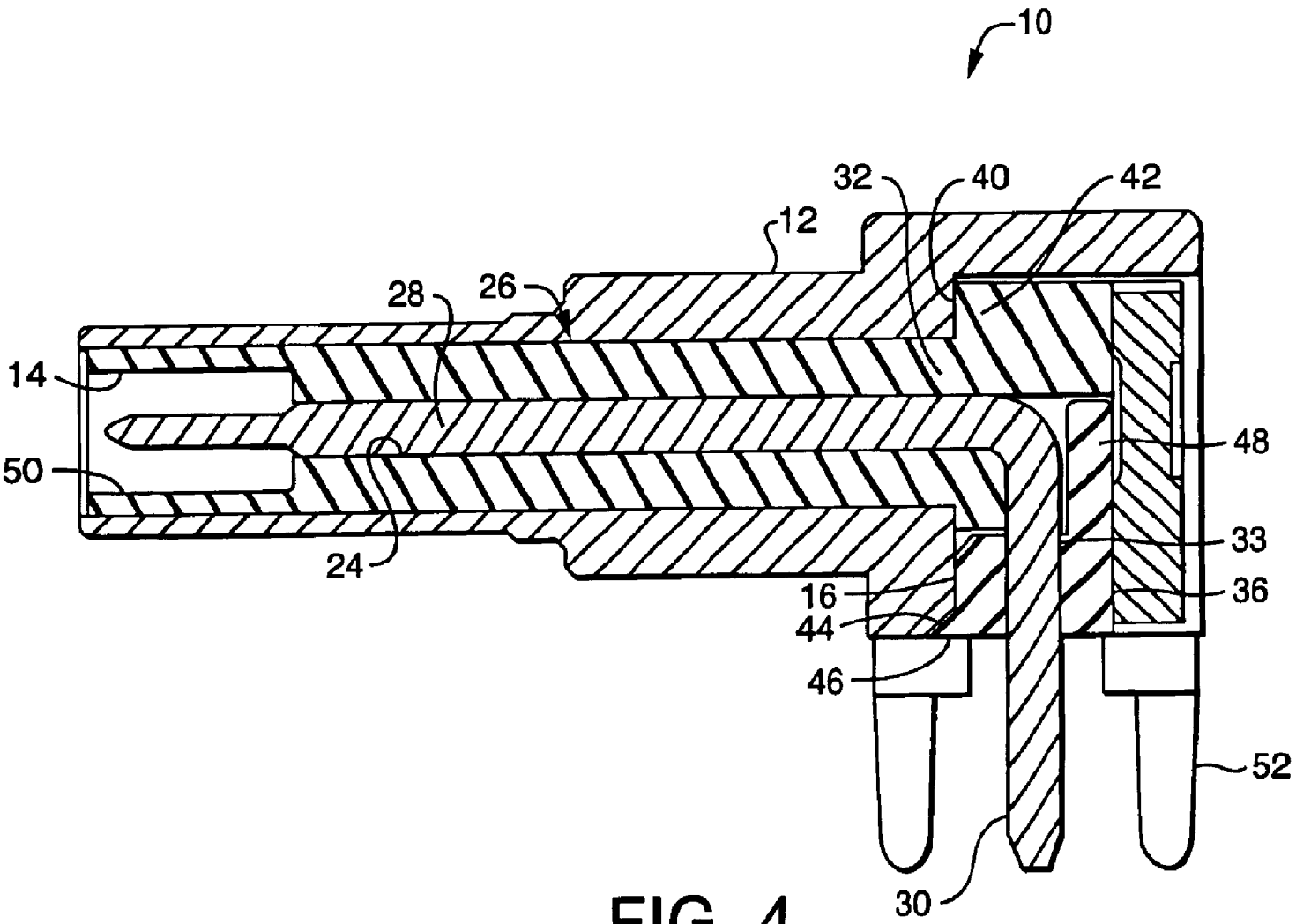
FIG. 4 is a longitudinal sectional view of the connector of FIG. 3.
Figure 5:
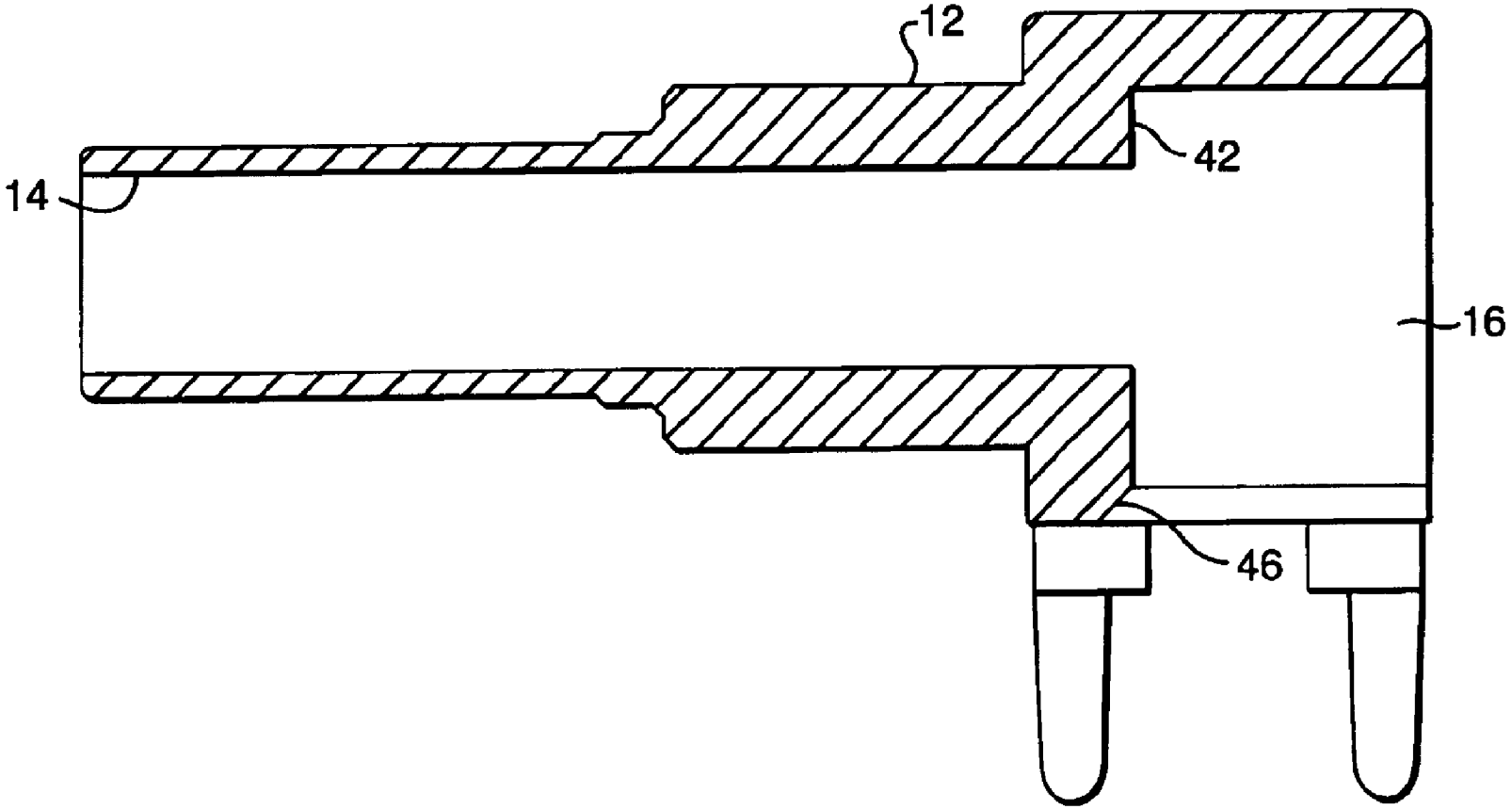
FIG. 5 is a longitudinal sectional view of the connector body alone.

Referring now to the invention with greater particularity, there is shown in FIGS. 3 and 4 a high frequency, right angle socket 10 comprising a body 12 including a longitudinal bore 14 extending completely through the body 12 and a transverse bore 16 intersecting the longitudinal bore 14. The bores 14 and 16 are seen most clearly in FIG. 5. A first dielectric 18 is formed to frictionally engage the longitudinal bore 14. The dielectric 18 has a proximal end 20 and a distal end 22 and includes a longitudinal electric contact-receiving chamber 24. A right angle electrical contact 26 has a longitudinal portion 28 and a transverse portion 30. The longitudinal portion 28 includes a first contact retainer 32. The transverse portion 30 includes a contact retainer 33. The longitudinal portion 28 is fitted into the longitudinal electrical contact-receiving chamber 24 of the first dielectric 18 with the contact retainer 32 on the longitudinal portion 28 engaging the interior wall of the longitudinal contact-receiving chamber 24. A second dielectric 34 is formed to frictionally engage the transverse bore 16 and includes a transverse electrical contact-receiving chamber 36 . The transverse portion 30 of the right angle electrical contact 26 is fitted into the transverse electrical contact-receiving chamber 36 with the contact retainer 33 on the transverse portion 30 engaging the interior wall of the transverse electrical contact-receiving chamber 36. A cap 38 closes one end of the longitudinal bore 14.

To aid in the accuracy of positioning the parts, the distal end 22 of the first dielectric 18 includes an external shoulder 40 that engages an internal shoulder 42 (see FIG. 5) formed in the longitudinal bore 14. Likewise, the second dielectric 34 includes a chamfered end 44 that engages a chamfered edge 46 at the terminus of the transverse bore 16.

The distal end 22 of the first dielectric 18 also includes an alignment slot 46 that fittingly receives an alignment tab 48 formed on the second dielectric 34 and the proximal end 20 of the first dielectric 18 has a cup-shaped depression 50 formed for a portion of its length to receive a connecting member.

To assemble the connector 10, the longitudinal portion 28 of the contact 26 is press-fitted into the first dielectric 18 to form a sub-assembly, which is then inserted into the die cast body 12. The contact retainer 32 engages the interior surface of the longitudinal contact receiving chamber 24 to fix the position of the contact. The second dielectric 34 is then placed upon the transverse portion 30 of the electrical contact 26 and inserted until contact is made between the chamfered end 44 of the second dielectric 34 and the chamfered edge 46 of the transverse bore 16. At that time the alignment tab 48 fills the alignment slot 46 formed in the distal end 22 of the first dielectric 18 completely sealing the contact 26 to achieve adequate shielding. The die cast cap 38 is then seated into the body 12 and coined into place, thus completing the assembly.

The dielectrics 18 and 34 are preferably plastic injection to accommodate the complex shapes.

Additionally the mounting posts 52 are round as opposed to square, as was the case with the prior connector, to provide improved soldering with the printed circuit board to which the connector 10 is mounted.

While there have been shown and described what are at present considered to be the preferred embodiments of the invention, it will be apparent to those skilled in the art that various changes and modification can be made herein without departing from the scope of the invention as defined by the appended claims.

What is claimed is:

1. A high frequency, right angle socket comprising:

a body including a longitudinal bore extending completely through said body and a transverse bore intersecting said longitudinal bore;

a first dielectric formed to frictionally engage said longitudinal bore, said dielectric having a proximal end and a distal end and including a longitudinal electric contact receiving chamber;

a right angle electrical contact having a longitudinal portion and a transverse portion, said longitudinal portion including a first contact retainer, said transverse portion including a second contact retainer, said longitudinal portion fitted into said longitudinal electrical contact receiving chamber of said first dielectric, said contact retainer on said longitudinal portion engaging the interior wall of said longitudinal contact receiving chamber;

a second dielectric formed to frictionally engage said transverse bore and including a transverse electrical contact receiving chamber, said transverse portion of said right angle electrical contact fitted into said transverse electrical contact receiving chamber, said contact retainer on said transverse portion engaging the interior wall of said transverse electrical receiving chamber; and a cap closing one end of said longitudinal bore.

2. The high frequency, right angle socket of claim 1 wherein said distal end of said first dielectric includes an external shoulder that engages an internal shoulder formed in said longitudinal bore.

3. The high frequency, right angle socket of claim 2 wherein said second dielectric includes a chamfered end.

4. The high frequency, right angle socket of claim 3 wherein said chamfered end of said second dielectric engages a chamfered edged at the terminus of said transverse bore.

5. The high frequency, right angle socket of claim 4 wherein said distal end of said first dielectric further includes an alignment slot and said second dielectric includes an alignment tab in engagement with said alignment slot.

6. The high frequency, right angle socket of claim 5 wherein said proximal end of said first dielectric is cup-shaped for a given depth.

7. The high frequency, right angle socket of claim 6 wherein said given depth is less than the length of said first dielectric.

8. The high frequency, right angle socket of claim 7 wherein said body is formed of electrically conductive material; said cap is formed of electrically conductive material and said cap is held in position by coining.

* * * * *